United States Patent [19]

Loyd, Jr.

[11] Patent Number: 4,566,388

[45] Date of Patent: Jan. 28, 1986

[54] METHOD OF MAKING FIREWORKS

[75] Inventor: Lew W. Loyd, Jr., So. Pittsburg, Tenn.

[73] Assignee: Space Age Manufacturing Co., Inc., Richard City, Tenn.

[21] Appl. No.: 638,931

[22] Filed: Aug. 9, 1984

[51] Int. Cl.[4] ..... F42B 4/04

[52] U.S. Cl. ..... 102/361; 102/530; 264/3 R

[58] Field of Search ..... 102/361, 530; 264/3 R

[56] References Cited

U.S. PATENT DOCUMENTS

| | | | |
|---|---|---|---|
| 511,644 | 12/1893 | Nelson | 102/361 |
| 547,921 | 10/1895 | Hunt | 102/361 |
| 619,177 | 2/1899 | Hinton | 102/361 |
| 675,102 | 5/1901 | Nordlinger | 102/361 |
| 840,242 | 1/1907 | Nordlinger | 102/361 |
| 1,253,596 | 1/1918 | Hitt | 102/361 |
| 2,817,294 | 12/1957 | Hjellnes | 102/361 |
| 3,749,018 | 7/1973 | Germershausen | 102/361 |
| 4,052,940 | 10/1977 | Gits et al. | 102/361 |

FOREIGN PATENT DOCUMENTS

| | | | |
|---|---|---|---|
| 650931 | 2/1929 | France | 102/361 |
| 1096928 | 6/1955 | France | 102/361 |
| 96660 | 8/1960 | Norway | 102/361 |
| 745192 | 2/1956 | United Kingdom | 102/361 |

*Primary Examiner*—Peter A. Nelson
*Attorney, Agent, or Firm*—Dowell & Dowell

[57] ABSTRACT

A method of constructing fireworks wherein a relatively small conventional Class C firework is assembled within an enlarged supplemental housing and wherein the relatively small Class C firework is positively retained in spaced relationship from the walls of the supplemental housing along its length and a safety fuse extends from said smaller firework and outwardly of said supplemental container.

1 Claim, 5 Drawing Figures

METHOD OF MAKING FIREWORKS

BACKGROUND OF THE INVENTION

1. Field of the Invention

This invention is generally directed to methods of manufacturing fireworks and particularly to a method of manufacturing fireworks wherein a relatively small Class C firework may be manufactured in a first location to include an explosive powder which is surrounded by a relatively soft paper shell and which is ignitable through the use of an enlarged safety fuse extending axially of the shell. Preferably, the relatively small firework is assembled at a second location, remote from the first location, within a supplemental housing having a width or diameter of at least twice that of the small firecracker. The small firecracker is mounted centrally within the supplemental enclosure and retained therein by a disc adhered to each end thereof with the safety fuse being extended through one of the discs so as to extend exteriorly of the supplemental enclosure.

2. History of the Invention

Over the years there have been numerous developments in the manufacture of fireworks and firecrackers. In more recent times, emphasis has been placed on developing fireworks which can be more safely handled by the consuming public without fear of accidents or injuries. In this regard, the Department of Transportation and the Consumer Product and Safety Commission of the Federal Government have set strict regulations with regard to the construction and handling of fireworks which may be sold to the general public. The Consumer Product and Safety Commission has also made significant inroads into the control and safe use and manufacture of fireworks. Over the past few years, the amount of explosive in fireworks to be sold to the general public has been restricted to a limit of 50 milligrams or approximately 0.772 grains of powder. The increase in safety is substantial when it is considered that the use of fireworks having 10 grains of powder was prevalent just 10 to 20 years ago.

The reduction in the amount of powder permitted by federal authorities has increased the safety factor but, of course, has reduced the noise level which is attainable using conventionally manufactured firecrackers. Most of the legally permitted firecrackers use a paper housing which is approximately $\frac{1}{4}$ of an inch in diameter and 1 inch or $1\frac{1}{2}$ inch in length and which has a paper and powder fuse which extends therefrom. The housing contains no more than 50 milligrams of explosive powder. The problem continues, however, that the use of conventional 1 inch or $1\frac{1}{2}$ inch Class C fireworks presents a potential safety risk to the user. All too often accidents result from the improper handling of fireworks and thus it is imperative that the fireworks be constructed so as to decrease the potential for accidents and injury even by the careless user.

In an attempt to make fireworks safer, some manufacturers are beginning to place a powder charge within a reinforced or stronger housing having a size and diameter which is significantly greater than the standard 1 inch by $\frac{1}{4}$ diameter firework. In U.S. Pat. No. 4,052,940 to Gits et al., a firecracker is disclosed which utilizes a casing of approximately 1 to $1\frac{3}{4}$ inches in length by $\frac{1}{2}$ to $\frac{5}{8}$ inches in inside diameter to retain an explosive charge. The explosive charge is retained in a supplemental chamber formed within the housing by capped ends which are inserted and adhered inwardly of the ends of the casing after which a sealant material is applied to the ends and outside of the sealing caps.

One of the purposes achieved by using a larger housing to retain a small explosive charge is to increase the audible characteristics of the firework by balancing the bursting effect of the housing together with the sealing plugs or caps at either end thereof. As disclosed in the above referenced patent, however, the explosive charge is freely disposed within the central portion of the firework, and the fuse is extended directly through the side wall of the casing. Therefore, not only is the charge able to leak through the opening in the sidewall of the housing where the detonating fuse is extended, but as the detonating charge is free to engage the inner sidewall of the housing, such charge may be ignited while in intimate contact with the container walls thereby presenting the possibility of injury in the event the firecracker prematurely explodes in the hands of the user.

Another prior art attempt to create safer small charge fireworks makes use of a housing of generally the same size as that disclosed in the aforementioned patent to Gits et al. In this other prior art structure, the charge is contained within a plastic capsule from which a detonating fuse extends so as to be axially positioned outside the firecracker housing. The ends of the housing are sealed after the chamber surrounding the capsule has been filled with sawdust which initially holds the capsule in place. With this type of construction, the small capsule containing the explosive charge may be agitated or shifted to a position engaging the sidewalls of the firecracker housing. Therefore, this construction presents the same potential risk of the exposive charge being ignited against the sidewall of the firecracker thereby potentially injuring a person who may be handling the firework. Additionally, the sawdust will also have an affect of muffling the retort and thereby reduce the audible level of the salute or firecracker.

A remaining problem which has not been addresed by the prior art is in the handling and manufacturing techniques involved with fireworks. In both the aforementioned prior art fireworks, the total firecracker is assembled at one location where the powder charge is introduced either directly into the firecracker housing or first into a supplemental capsule and thereafter inserted into the firecracker housing. Thus, the manufacture of these prior art fireworks require that the explosive charge be handled at the point of assembly of the completed firecracker.

In addition to the foregoing, there are numerous patents which discuss general methods of constructing and assembling fireworks as well as structures for pyrotechnic devices including fireworks. In U.S. Pat. No. 2,817,294 to Hjellnes, a training device is disclosed wherein an explosive charge is carried within a first container and thereafter placed into a supplemental housing having a elongated end portion which functions as a handle. The pyrotechnic device is designed to act as a training grenade with the explosive charge being carried at one end of the elongated tubular handle or casing. The design and structure of the device is somewhat complicated as it is intended for use as a military training device and not as a firework to be used by the general public.

Other examples of the prior art include Norwegian Pat. No. 96,660; French Pat. No. 650,395; British Pat. No. 745,192; and U.S. Pat. Nos. 511,644 to Nelson;

547,921 to Hunt; 619,177 to Hinton; 675,102 to Nordlinger; 840,242 also to Nordlinger; and 1,253,598 to Hitt.

SUMMARY OF THE INVENTION

This invention is directed to a method of manufacturing firecrackers of the Class C type wherein a first Class C firework may be manufactured in a first locality and includes an explosive charge not greater than that permitted in accordance with Federal Regulations which is contained within a generally soft paper housing and which has a safety fuse extending therefrom. The first firecracker may be shipped to a second locality where the first firecracker is placed within a supplemental housing having a diameter at least twice as great as that of the first firecracker. The first firecracker is retained in the supplemental housing so as to be in spaced relationship with the sidewalls thereof along its length. In this manner, a continuous airspace is created between the first firework and the supplemental housing. The first firework is retained in mounted position by end caps which are sealed by a hot glue mixture with the safety fuse from the small firecracker extending generally axially of the supplemental container.

It is a primary object of the present invention to provide a method of manufacturing fireworks wherein a standard 1 inch firecracker may be assembled into a supplemental housing without the requirement of having to directly handle the explosive charge thereby increasing the safety factor to those assembling the finished firecracker.

It is another object of the present invention to provide a method of manufacturing firecrackers of the Class C type wherein a conventional 1 inch firecracker can have a safety fuse incorporated therewith so that thereafter the conventional firecracker can be housed within a larger supplemental tube in such a manner that the conventional firecracker is retained and spaced in generally axial alignment with the supplemental tube so that a continuous airspace is created therebetween thereby increasing the audible level of the retort of the small firecracker.

It is another object of the present invention to create a firecracker which is safer to handle even though containing the same number of grains of explosive as other legally permissible firecrackers wherein a first conventional 1 inch firework is manufactured at a first locality using an enlarged safety fuse and wherein the 1 inch firecracker is thereafter shipped to a second location which is remote from the first locality where said firecracker is assembled within an enlarged housing in such a manner that the first firecracker is maintained in spaced relationship with the walls of the enlarged housing so that an airspace is created completely around the first firecracker thereby reducing the risk of injury in the event of premature explosion of the first firework within the enlarged housing by spacing the explosive material from the sidewalls thereof.

DESCRIPTION OF THE PREFERRED EMBODIMENT

Figure 1:
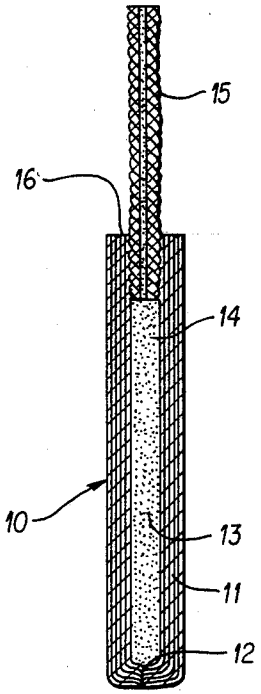
FIG. 1 is a cross-sectional view showing an 1 inch firecracker having a safety fuse placed therein.
Figure 2:
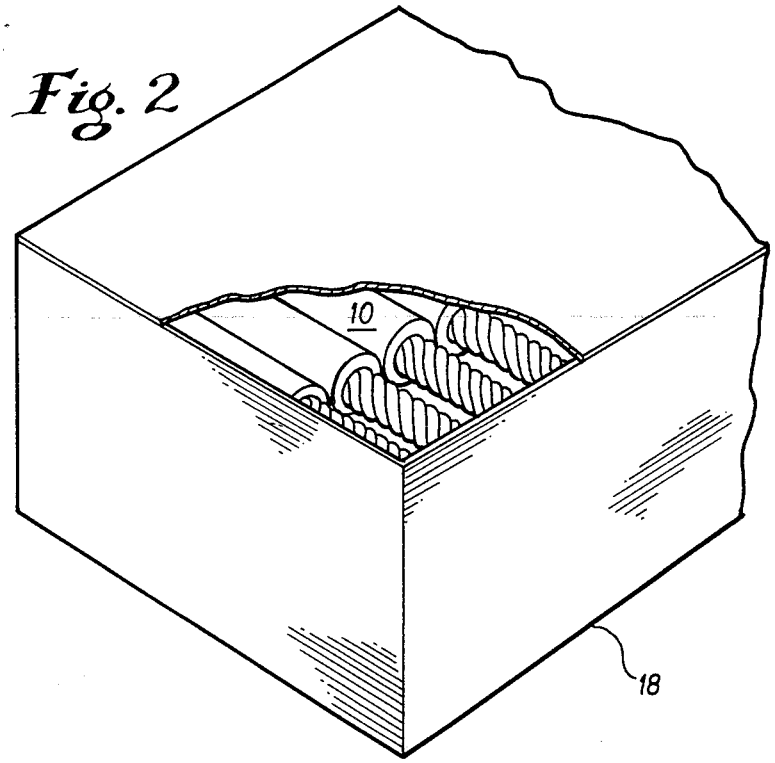
FIG. 2 is an illustrational view having portions broken away of a container for transporting conventional 1 inch firecrackers.
Figure 3:
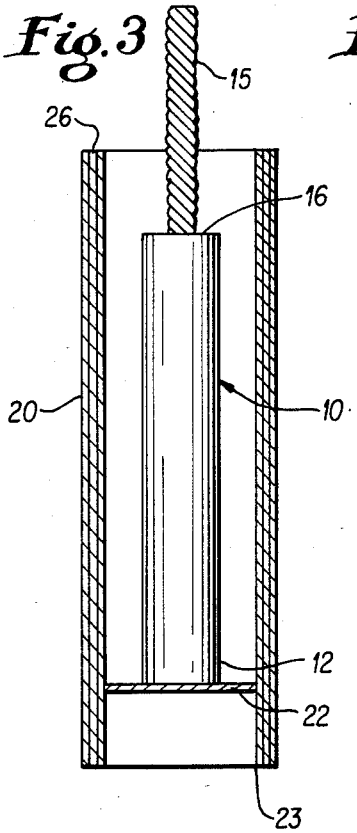
FIG. 3 through FIG. 5 show steps of mounting a conventional firecracker having a safety fuse incorporated therewith within a supplemental housing by a series of steps which include sealing the conventional 1 inch firecracker in spaced relationship with a supplemental housing.

As previously discussed, it is one of the primary objects of the present invention to provide a method for making conventional 1 inch firecrackers more safe for consumer use. With specific reference to FIGS. 1 and 2, there is disclosed a conventional 1 inch Class C firecracker 10 having a multi-layered paper housing or casing 11 which is sealed along the lower portion 12 thereof by crimping the paper shell to close off the central bore 13. A charge of explosive powder 14 not exceeding 50 milligrams or any other amount regulated by law fills the central hollow portion 13 after which a safety fuse 15 is inserted into the upper end 16 of the firecracker. In most conventional fireworks, the fuse is formed of paper, however, it is proposed to manufacture the conventional firecracker, shown in FIG. 1, incorporating a relatively hard safety fuse of the type which is normally used on more explosive pyrotechnic firecracker or firework devices. After the 1 inch Class C firecrackers are manufactured they are packaged by placing them in a box 18 or similar container for shipment to a second processing locality. Generally, the bulk of the Class C, firecrackers are imported from China.

In order to make conventional firecrackers safer while increasing the retort or audible noise level for a conventional firecracker, the conventional firecrackers will be individually placed within supplemental housings or tubes 20 of a size which is substantially greater than the size of the conventional firecracker. A conventional firecracker is generally 1 inch long and $\frac{1}{4}$ inch in diameter whereas the housing 20 will be constructed up to an $1\frac{1}{2}$ inch long and greater than $\frac{1}{2}$ inch and preferably $\frac{5}{8}$ of an inch in diameter. The supplemental container or housing is fabricated of a stronger paper tube than that enclosing the conventional firework, and may have one or more wraps totalling a wall thickness of approximately 0.03 inches, plus or minus 0.015 inch.

Figure 4:
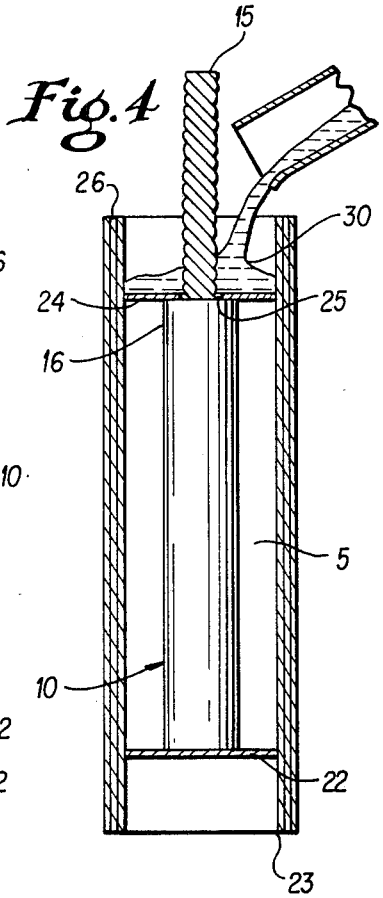
Figure 5:
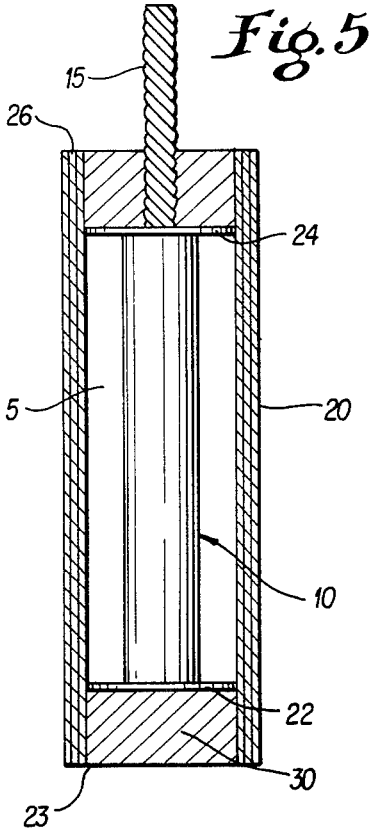

Although the particular steps in assembling the conventional firecracker 10 within the supplemental housing 20 may vary, it is necessary to insure that the conventional firecracker 10 is generally axially aligned in spaced relationship within the supplemental container so as to form a continuous airspace S between the conventional firecracker housing 11 and the inner wall 21 of the supplemental container 20, as shown in FIGS. 4 and 5. The supplemental housing 20 is provided with a lower partition 22 which is generally circular and fabricated of a paper material which is wedged inwardly of the lower end 23 of the housing so as to be spaced inwardly therefrom approximately $\frac{1}{4}$ of an inch.

The conventional firecracker 10 is placed into the supplemental housing with the lower portion 12 thereof resting against the paper disc 22 closing the bottom of the container. Again, the conventional firecracker should be spaced from the sidewalls 21 of the supplemental container along the entire length thereof. In order to seal or close the upper portion of the supplemental housing or container, a paper disc 24 having a centrally disposed opening 25 therein is positioned over the fuse and slid down into abutting engagement with the uppermost portion or end 16 of the conventional firecracker, as shown in FIG. 4. The paper disc 24 should also be spaced inwardly approximately ¼ of an inch from the upper end 26 of the housing.

After the components of the composite firework have been assembled, the upper and lower ends thereof are sealed using a "hot glue" generally indicated at 30. The advantage of using the "hot glue" is that the glue will not set up and dry over a period of time but will remain somewhat elastic thereby making the device even safer during use and further preventing withdrawal of the conventional firework from the larger housing. Th completed firework will in cross-section resemble the composite firework shown in FIG. 5 and will include a safety fuse 15 which is both secured to the conventional firecracker 10 and to the housing 20.

It should be noted from the above discussion that a conventional firecracker can be manufactured and shipped from one location to a remote location at which remote location a composite firework can be manufactured which is safer in use and yet provides for a louder retort than the initial firecracker. The increase in safety and desirability of increased retort is accomplished without ever having to disturb the explosive charge 14 contained in the conventional firework. Therefore, by the system of the present invention, it is possible to increase the desirability and safety of the conventional firework under safe conditions.

The method has the benefit of permitting manufacturers to convert existing supplies of commercially available Class C firecrackers into safer and louder firecrackers. Further, the risks to employees repacking or placing the conventional firecrackers into supplemental housing is reduced as the detonating charge need not be directly handled or exposed.

I claim:

1. A method of converting conventional Class C fireworks having an explosive body portion and a safety fuse which extends therefrom into safer and louder firecrackers comprising the steps of:

(A) forming a housing having a cylindrical side wall and first and second end portions of a size to completely receive the body portion of a conventional Class C firecracker therein so that an air space is created between the side walls of the cylindrical housing and the body portion of a conventional Class C firecracker, (B) inserting the conventional Class C firecracker within the cylindrical housing so as to be spaced inwardly of said side walls thereof and spaced inwardly of said end portions thereof and in such a manner that the safety fuse extends outwardly of said housing adjacent one end portion thereof, (C) closing the end portions of the cylindrical housing by inserting first and second material disks therein so as to firmly abut the conventional Class C firecracker and simultaneously engage the cylindrical side walls of said housing, (D) sealing the material disks to the cylindrical side walls of the housing by filling the end portions of said housing with a glue.

* * * * *